US008968034B2

(12) United States Patent
Hsu

(10) Patent No.: US 8,968,034 B2
(45) Date of Patent: Mar. 3, 2015

(54) ELECTRICAL CONNECTOR HAVING A TONGUE WITH SIGNAL CONTACTS AND A PAIR OF POSTS WITH POWER CONTACTS

(71) Applicant: Hon Hai Precision Industry Co., Ltd., New Taipei (TW)

(72) Inventor: Kuo-Chun Hsu, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 47 days.

(21) Appl. No.: 13/940,269

(22) Filed: Jul. 12, 2013

(65) Prior Publication Data

US 2014/0017921 A1 Jan. 16, 2014

(30) Foreign Application Priority Data

Jul. 13, 2012 (TW) ..... 101213524 U

(51) Int. Cl.

| | |
|---|---|
| ***H01R 24/28*** | (2011.01) |
| ***H01R 13/46*** | (2006.01) |
| ***H01R 24/60*** | (2011.01) |
| ***H01R 27/00*** | (2006.01) |
| *H01R 12/72* | (2011.01) |

(52) U.S. Cl.

CPC ..... *H01R 13/46* (2013.01); *H01R 24/60* (2013.01); *H01R 27/00* (2013.01); *H01R 12/724* (2013.01)

USPC ..... 439/660

(58) Field of Classification Search

USPC ..... 439/660, 166, 172–175

See application file for complete search history.

(56) References Cited

U.S. PATENT DOCUMENTS

| | | | | |
|---|---|---|---|---|
| 7,377,821 | B2 * | 5/2008 | Chen et al. | 439/680 |
| 7,396,258 | B2 * | 7/2008 | Zhang | 439/660 |
| 8,337,254 | B2 * | 12/2012 | Jin | 439/675 |
| 2008/0064267 | A1 * | 3/2008 | Zhang | 439/676 |
| 2012/0302104 | A1 * | 11/2012 | Wu | 439/660 |
| 2013/0040485 | A1 * | 2/2013 | Ngo | 439/350 |

FOREIGN PATENT DOCUMENTS

| | | |
|---|---|---|
| CN | 201312041 | 8/2008 |
| TW | M386645 | 1/2010 |

* cited by examiner

*Primary Examiner* — Peter Szekely

(74) *Attorney, Agent, or Firm* — Wei Te Chung; Ming Chieh Chang

(57) ABSTRACT

An electrical connector is used to mate with a first plug connector and a second plug connector, the first and second plug connectors have different mating interfaces. The electrical connector includes a housing, defining a mating tongue, a plurality of signal terminals with contacting portion arranged on the mating tongue, and a metallic shell surrounding the mating tongue, thereby defining a mating cavity into which the mating tongue extends. The housing defines a pair of extending posts extending into the mating cavity and located at two opposite sides of the mating tongue and spaced from the mating tongue with a gap. The extending posts are loaded with a pair of power terminals thereon. The mating cavity constructs a first mating port and the extending posts excluding the extending posts and two subsidiary ports into which the pair of extending posts extend.

20 Claims, 7 Drawing Sheets

ELECTRICAL CONNECTOR HAVING A TONGUE WITH SIGNAL CONTACTS AND A PAIR OF POSTS WITH POWER CONTACTS

BACKGROUND OF THE INVENTION

1. Field of the Invention

The present invention relates to an electrical connector, and more particularly to a co-port electrical connector that can receive different plugs.

2. Description of the Related Art

Chinese Patent issue No. 201312041 on Sep. 16, 2009, owned to Molex Incorporated, discloses an electrical connector. The electrical connector includes an insulative housing, a plurality of conductive terminals fixed to the housing, and a metal shied covering the housing. The housing defines a tongue portion. The shell surrounds the housing to define a mating cavity. The terminals are arranged on both the upper and lower surfaces of the tongue portion. A first terminal on the outmost edge of each surface of the tongue portion is a power contact and the rest are signal contacts. The connector is designed to be only inserted with a predetermined plug connector.

Therefore, an improved electrical connector is desired to overcome the disadvantages of the related arts.

BRIEF SUMMARY OF THE INVENTION

An object of the present invention is to provide an electrical connector which can respectively mate with two plug connectors that have different mating interfaces.

In order to achieve above-mentioned object, an electrical connector is used to mate with a first plug connector and a second plug connector, the first and second plug connectors have different mating interfaces. The electrical connector comprises a housing, defining a mating tongue, a plurality of signal terminals with contacting portion arranged on the mating tongue, and metallic shell surrounding the mating tongue, thereby defining a mating cavity into which the mating tongue extends. The housing defines a pair of extending posts extending into the mating cavity and located at two opposite sides of the mating tongue and spaced from the mating tongue with a gap. The extending posts are loaded with a pair of power terminals thereon. The mating cavity constructs a first mating port and the extending posts excluding the extending posts and two subsidiary ports into which the pair of extending posts extend.

Other objects, advantages and novel features of the invention will become more apparent from the following detailed description of the present embodiment when taken in conjunction with the accompanying drawings.

DESCRIPTION OF PREFERRED EMBODIMENT OF THE INVENTION

Figure 1:
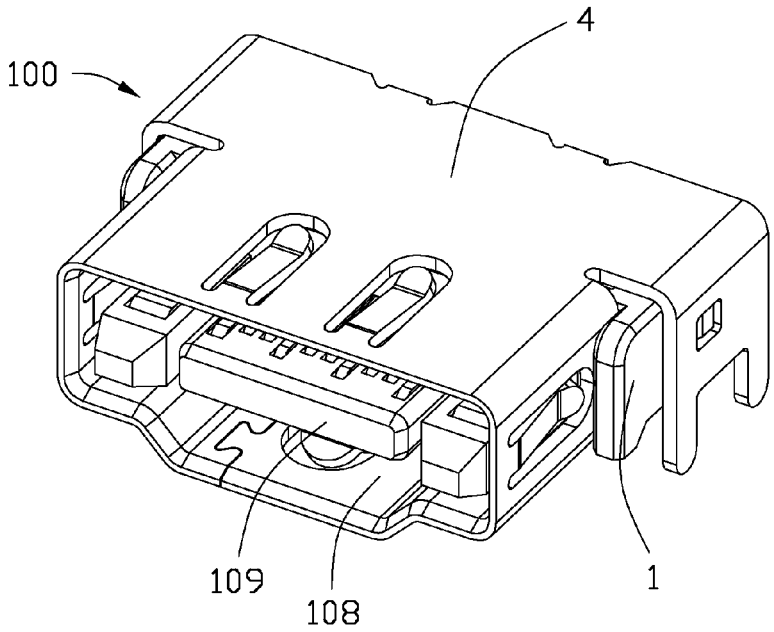
FIG. 1 is a front and top perspective view of an electrical connector in accordance with the present invention.
Figure 2:
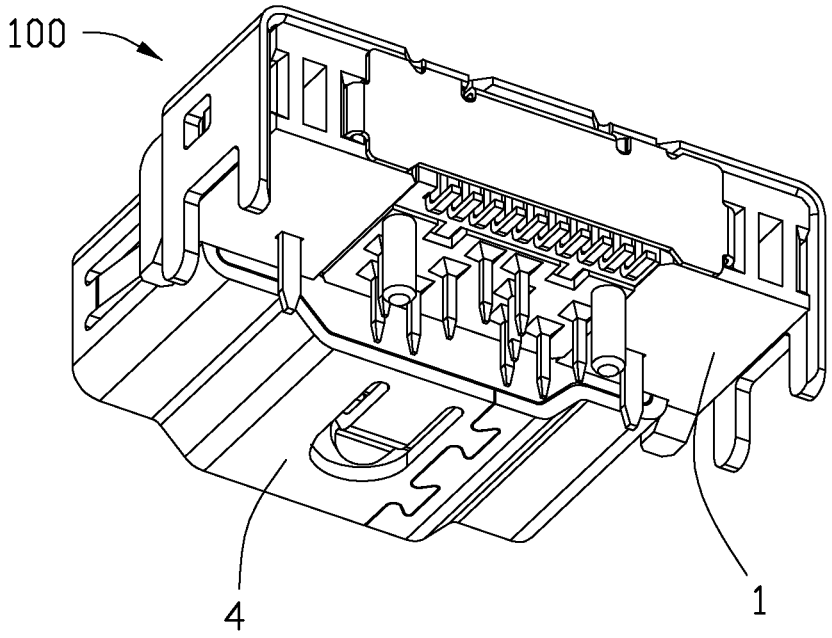
FIG. 2 is a rear and bottom view of the electrical connector shown in FIG. 1.
Figure 7:
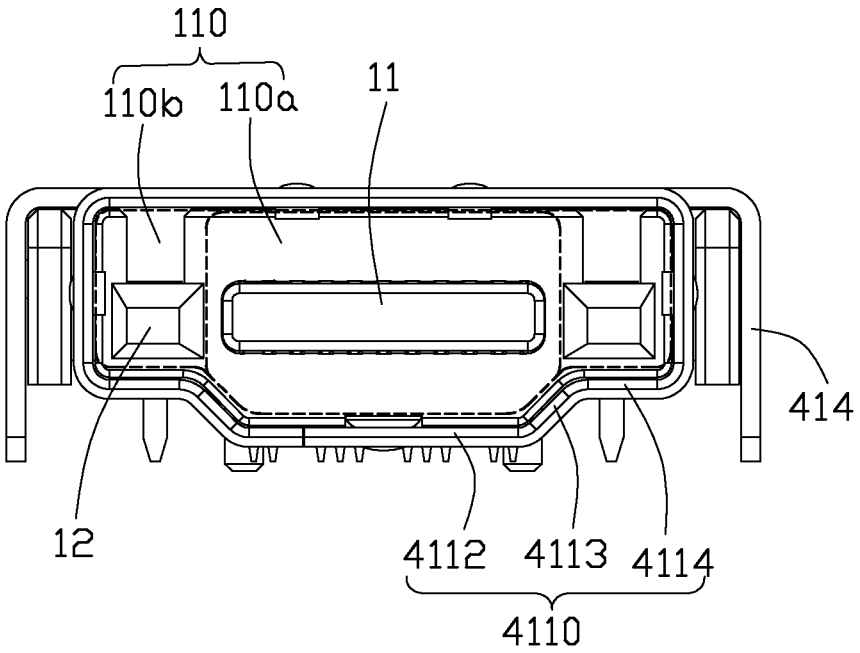
FIG. 7 is a front view of the electrical connector shown in FIG. 1.

Reference will now be made to the drawing figures to describe a preferred embodiment of the present invention in detail. FIG. 1, 2 and FIG. 7 illustrate an electrical connector 100, which is used to mate with a first plug connector and a second plug connector (not shown). The first and second plug connectors have different mating interfaces. In a preferred embodiment, the first plug connector is a non-standard thunderbolt connector and the second plug connector is a standard thunderbolt connector. The standard thunderbolt connector has twenty pins, a fourth pin and a sixth pin are used to transmit the PCI-E signals. The electrical connector 100 defines a housing 1 made from insulative material, a plurality of terminals fixed to the housing 1 and a metallic shell 4 covering the housing 1. The housing 1 defines a mating tongue 109 surrounded by the metallic shell 4, thereby defining a mating cavity 108 into which the mating tongue 109 extends.

Figure 3:
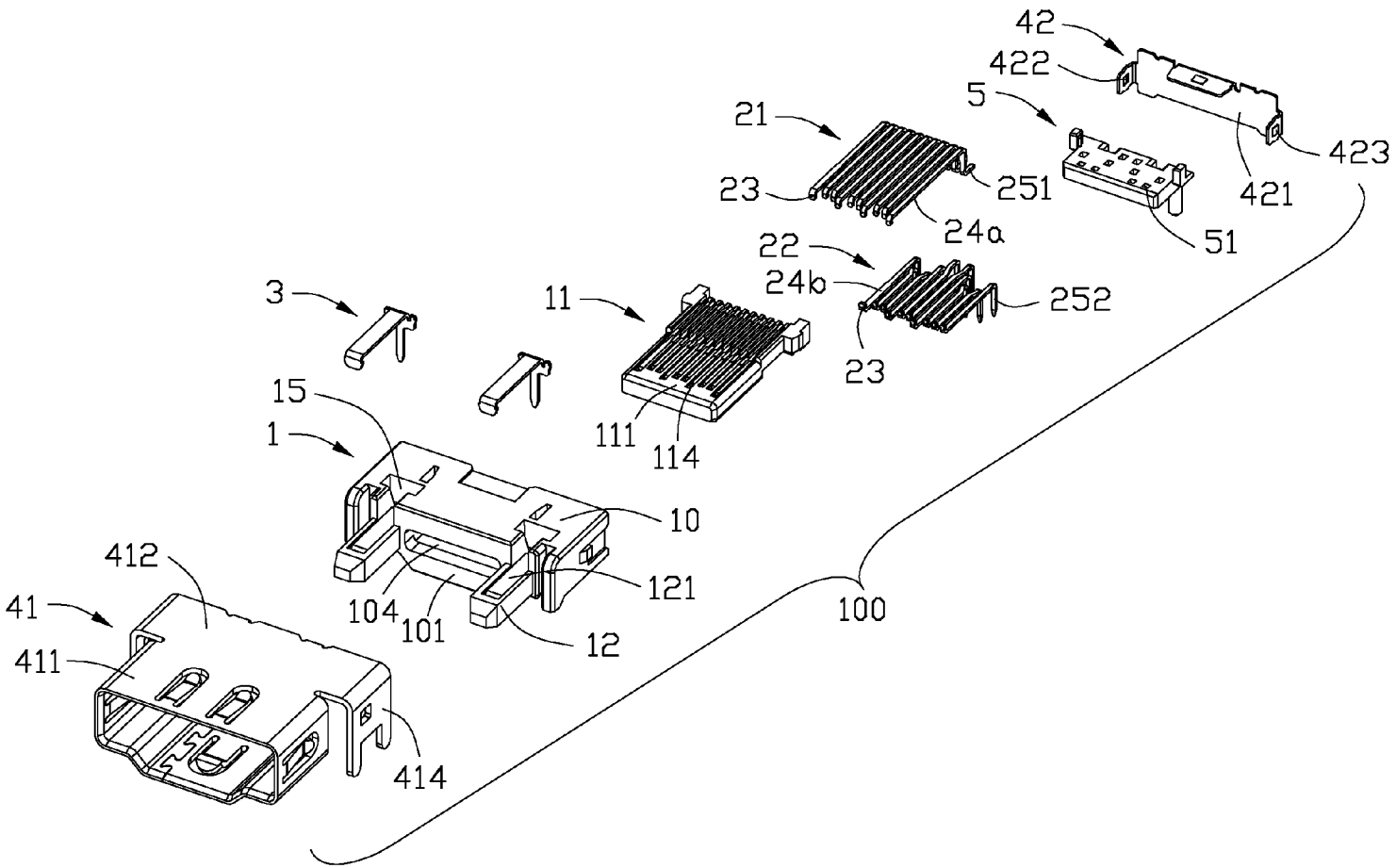
FIG. 3 is an exploded perspective view of the electrical connector shown in FIG. 1.
Figure 4:
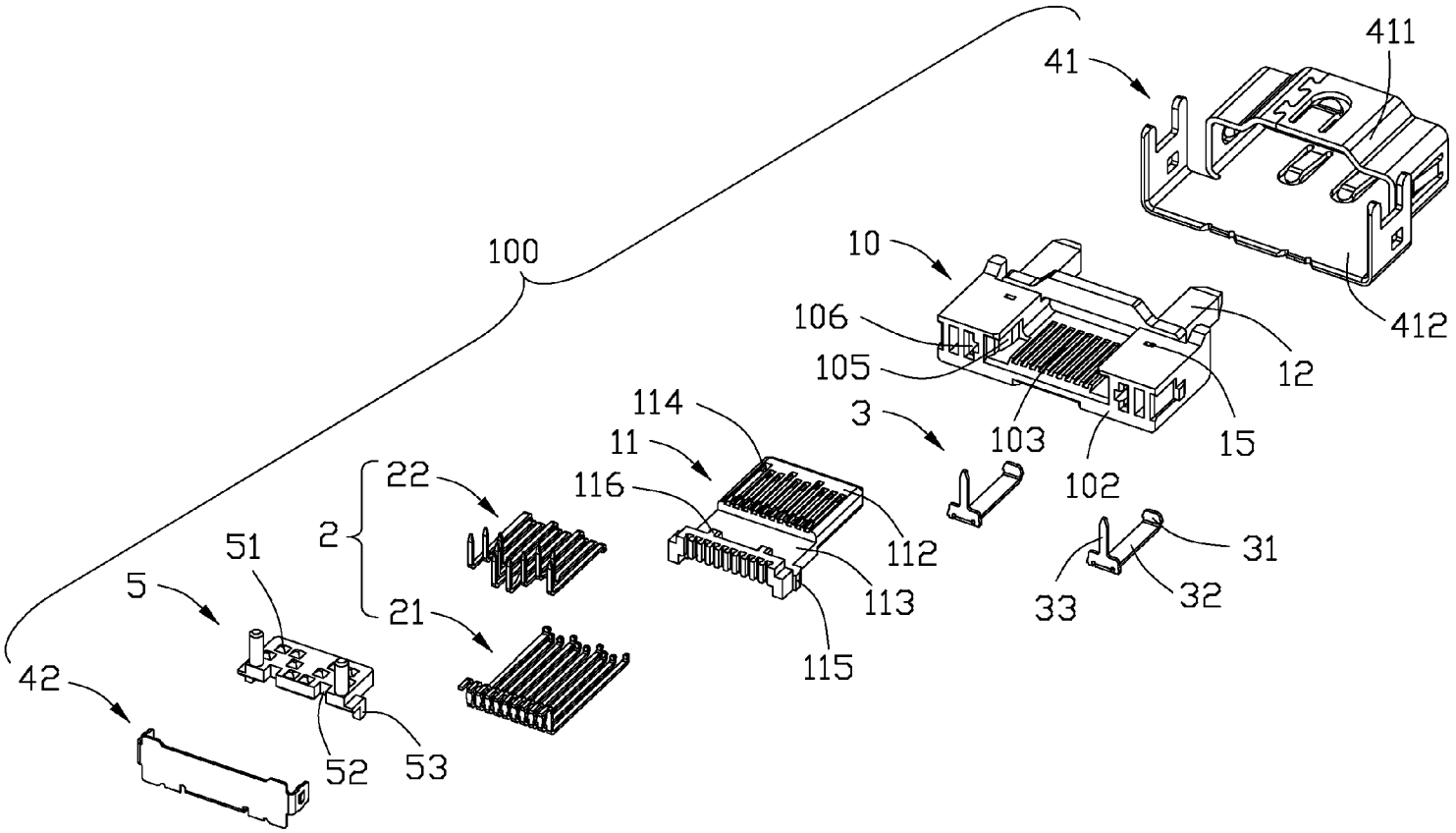
FIG. 4 is another exploded view of the electrical connector shown in FIG. 3.
Figure 5:
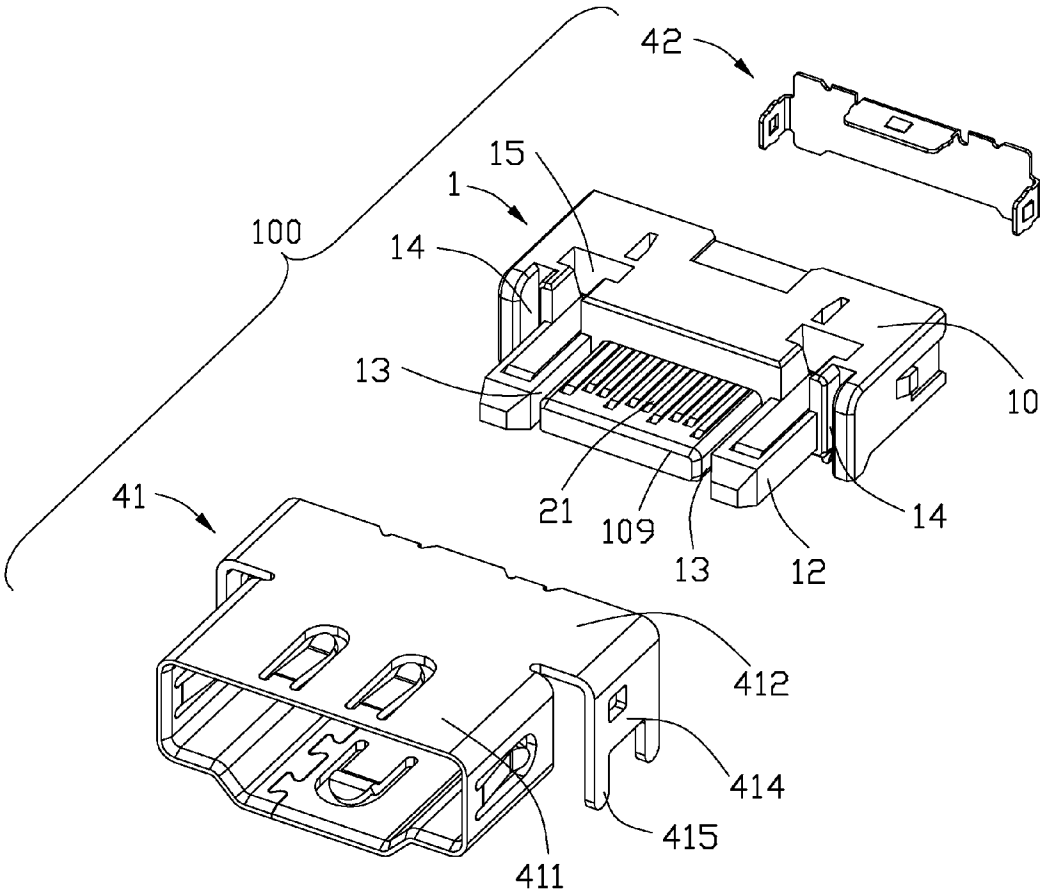
FIG. 5 is a partially explode view of the electrical connector shown in FIG. 1.

Referring to FIGS. 3 to 5, the housing 1 includes a base member 10, a tongue member 11 loaded with a plurality of terminals 21, 22. In this embodiment, the tongue member 11 defines a first/upper surface 111, a second/lower surface 112 and two rows of terminals 21, 22 each comprise contacting portions 24*a*, 24*b* arranged on corresponding passageways 114 on the first and second surface 111, 112 respectively, and tail portions 251, 252 extending out of the rear surface 102. The base member 10 defines a retained slot 104 running through the front surface 101 from the rear surface 102 of the base member 10, and the retained cavity 103 running through the bottom surface of the base member 10. The tongue member 11 is inserted into the retained slot 104 from the rear surface 102, a front portion of the tongue member 11 protrudes to the front surface 101 so as to be defined as the mating tongue 109 and a rear portion is received in the retained cavity 103. A pair of leading notches 105 is defined at an entrance of the retained cavity 103 to guide insertion of the tongue member 11. A pair of guiding portions 115 is set at two opposite sides of the tongue member 11. The pair of leading notches 105 are defined at the entrance of the retained cavity 103 to engage with the guiding portions 115 to guide an insertion of tongue member 11.

Figure 6:
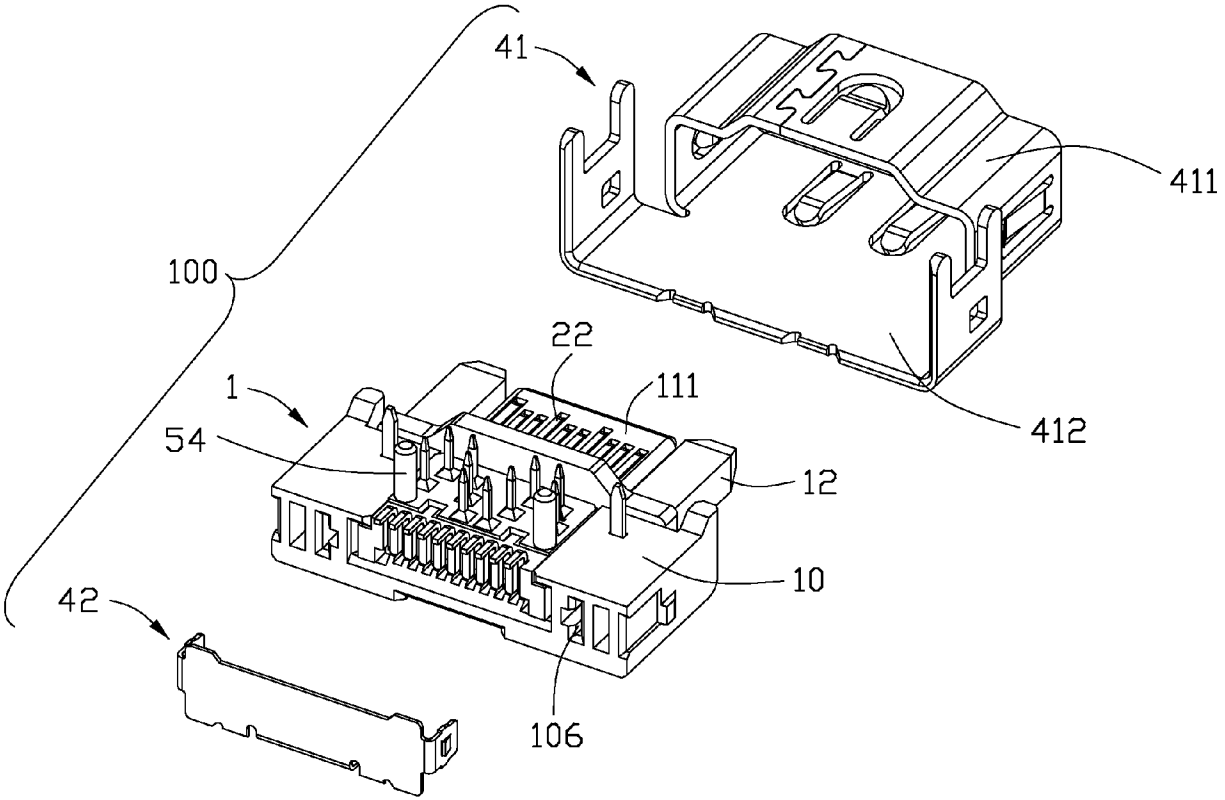
FIG. 6 is another view of the electrical connector shown in FIG. 5.

The base member 10 further defines a pair of extending posts 12 integrally extending from a front surface 101 of the base member 10. The two extending posts 12 is located at two opposite sides of the mating tongue 109 and spaced from the mating tongue 109 with a pair of gaps 13, as best shown in FIGS. 5 and 6. A pair of power terminals 3 is assembled in grooves 121 defined in the upper surface of the extending posts 12. The power terminals 13 include contacting portions 32 exposed on the grooves 121 of the extending posts 12 and flushed with the contacting portions 24*a*, 24*b* of terminals 2 and tail portions 33 are running through the bottom surface of the housing 1 at two sides of the tail portions 251, 252. The base member further defines a pair of holes 15 nearby and communicating with each groove 121. The power terminals 3 are inserted into the grooves 121 from the top of the base member 10 and the tail portions 33 are inserted into the holes 15 and then through the bottom of the base member 10.

The tongue member 11 defines a sinking hollow 113 recessed at the second surface 112 and two protrusions 116 extending forward into the sinking hollow 113. A spacer 5 is assembled to the sinking plate 113 of the tongue member 11 as best shown in FIG. 6. The spacer 5 defines a plurality of holes 51 through which the tail portions 252 go to be positioned, so that the tail portions 252 will not contact each other and the strength of the tail portions 252 will be improved. The tail portions 251 are parallel to a PCB on which the connector is intended to be mounted, and the tail portions 252 are vertical to the PCB. The tail portions 251 and the tail portions 252 are in a front-back arrangement. Two notches 52 disposed at the spacer 5 are corresponding to the protrusions 116 of the sinking hollow 113. As a result, the position of the spacer 5 on tongue member 11 is ensured. Resisting portions 53 project outward to the side surface of the spacer 5, which are resisting onto the front surface of the guiding portions 115.

In a preferred embodiment, terminals 21, 22 are signal terminals, and terminals 3 are power terminals. In this embodiment, the signal terminals 21, 22 are used to transmit the signal of the thunderbolt connector and the power terminals 3 are used to pass DC power. The tongue member 11 and the extending posts 12 are separated. In other embodiments, the tongue member 11 maybe extends from the base member 10 and the extending posts 12 are assembled to the base member 10, or both the tongue member 11 and the extending posts 12 are assembled to the base member 10.

The base member 10 defines a pair of slots 14 at outsides of the extending posts 12. Referring to FIGS. 5 to 7, the metallic shell 4 includes a main member 41 and a rear cover 42 separating from the main portion 41. The main member 41 has a frame mating portion 411 and a board portion 412. The frame mating portion 411 surrounds the mating tongue portion 109 and extending posts 12 thereby defining said mating cavity 108, and a rear portion of the frame mating portion 411 is inserted into the slots 14 so that it can be fixed onto the base member 10. Board portion 412 extends two side portions 414 covering the side surfaces of the base member 10, which has two solder legs 415. The rear cover 42 defines a main portion 421 and a pair of latch arms 422 extending downward from the two sides of the main portion 421. The main portion 421 covers on the rear surface 102 of the base member 10 and the latch arms 422 are inserted into the holes 106 of the base member 10 besides the leading notches 105.

As best shown in FIG. 7, the mating cavity 108 defined by the shell 4 is in a co-port pattern, which adapted for being inserted with two different plugs respectively. A first mating port 110*a* is bounded by the top wall, bottom wall of the shell 4 and the inside sides of the extending posts 12, which is intended for insertion of the second plug connector, i. e, the standard thunderbolt connector. The second mating port 110 is bounded by the frame 411 of the metallic shell 4, that is, the second mating port 110 is composed of the first mating port 110*a* and two subsidiary ports 110*b* at opposite sides of the first mating port 110*a* which is intended for inserted of the first plug connector. i. e. the standard thunderbolt connector with power terminals, illustrated in dotted lines in FIG. 7. The extending posts 12 are disposed in the subsidiary ports 110*b* and outside of the first mating port 110*a*. The bottom wall 4110 of the frame mating portion 411 includes a lowest horizontal portion 4112 and two slant portions 4113 and two upper horizontal portions 4114 in order. The five portions of the bottom wall 4110 connect in turn. The first mating port 110*a* is bounded by the lowest horizontal portions 4112 and the two slant portions 4113 at the bottom, while the 110*b* is bounded by the upper horizontal portions 4114 at the bottom. That means, the insides of the extending posts 12 are aligned with the slant portions 4113 in a height direction.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. An electrical connector is used to mate with a first plug connector and a second plug connector, the first and second plug connectors having different mating interfaces; the electrical connector comprising:

a housing, defining a mating tongue;

a plurality of signal terminals with contacting portion arranged on the mating tongue;

a metallic shell surrounding the mating tongue, thereby defining a mating cavity into which the mating tongue extends;

wherein, the housing defines a pair of extending posts extending into the mating cavity and located at two opposite sides of the mating tongue and spaced from the mating tongue with a gap, the extending posts are loaded with a pair of power terminals thereon;

wherein, the mating cavity constructs a first mating port excluding the extending posts, and two subsidiary ports into which the pair of extending posts extend.

2. The electrical connector as described in claim 1, wherein the extending posts integrally extend from the base member.

3. The electrical connector as described in claim 1, wherein the housing comprises a base member and a tongue member retained on the base member, the tongue member projects forward from the base member so as to be defined as the mating tongue.

4. The electrical connector as described in claim 3, wherein the tongue member defines a sinking hollow, and protrusions extending into the sinking hollow, a spacer is assembled in the sinking hollow with two notches thereon retaining the protrusions of the tongue member.

5. The electrical connector as described in claim 4, wherein a pair of guiding portions are defined at two opposite sides of the tongue member, and a pair of leading notches are defined at an entrance of the retained cavity to engage with the guiding portions to guide the an insertion of tongue member.

6. The electrical connector as described in claim 1, wherein the metallic shell includes a main member and a rear cover separating from the main member, the main member surrounding the mating tongue and the extending post, the rear cover covering on the rear surface of the base member.

7. An electrical connector comprising:

an insulative housing cooperating with a metallic shell to commonly define a center primary mating port and a pair of secondary mating ports by two sides of the primary mating port in a transverse direction, both said primary mating port and said pair of secondary mating ports forwardly communicating with an exterior in a front-to-back direction perpendicular to said transverse direction;

the housing including a base member with a pair of extending posts forming the pair of secondary mating port, and a tongue member being discrete from the base member to form said primary mating port;

said base member defining a retaining through slot to allow said tongue member to be forwardly inserted therethrough from a rear side of the housing;

a plurality of signal contacts configured to be allowed to be assembled to the mating tongue in a vertical direction perpendicular to both said transverse direction and said front-to-back direction only before said tongue member is assembled to the base member; and a plurality of power contacts configured to be assembled to the corresponding extending posts in the vertical direction only before the shell is assembled to the housing.

8. The electrical connector as claimed in claim 7, wherein the base member defines a front surface from which the extending posts extend forward and the retaining through slot is recessed rearwardly.

9. The electrical connector as claimed in claim 7, wherein the primary mating port and the secondary mating port aside are spaced from each other with a gap.

10. The electrical connector as claimed in claim 7, wherein said plurality of signal contacts are arranged with opposite upper and lower rows respectively mounted to two opposite faces of the tongue member.

11. The electrical connector as claimed in claim 10, wherein tails of the signal in the upper row are arranged in one row in a surface mounting manner while those in the lower row are arranged in three rows in a through hole manner showing a "W"-shaped footprint.

12. The electrical connector as claimed in claim 7, wherein the shell defines a vertically expanded section lower than other sections, and said expanded section is aligned with the primary mating port in the vertical direction.

13. The electrical connector as claimed in claim 12, wherein the base member defines a mounting surface for sit upon a printed circuit board, and said expanded section is lower than said mounting surface.

14. The electrical connector as claimed in claim 7, wherein each of said extending posts defines a groove rearwardly extending into the base member.

15. The electrical connector as claimed in claim 7, wherein said signal contacts include differential pairs and grounding contacts alternately arranged with each other, and tails of differential pairs are offset toward that of the neighboring grounding contacts, respectively.

16. An electrical connector comprising:

an insulative housing including a tongue member in a primary mating port at a center, and a base member with a pair of extending posts in a pair of secondary mating ports by two sides of the primary mating port in a transverse direction, both said primary mating port and said pair of secondary mating ports forwardly communicating with an exterior in a front-to-back direction perpendicular to said transverse direction;

a plurality of signal contacts disposed on the tongue member in the primary mating port;

a plurality of power contacts disposed on the base member in the secondary mating port; and a metallic shell enclosing said housing and the primary mating port and the secondary mating port; wherein said shell defines a vertically expanded section which is lower than other sections of the shell and aligned with the tongue member in a vertical direction perpendicular to both said transverse direction and said front-to-back direction.

17. The electrical connector as claimed in claim 16, wherein the tongue member is located at a center portion of the primary mating port in the vertical direction, while the extending post is located at a lower portion of the corresponding secondary mating port.

18. The electrical connector as claimed in claim 16, wherein said tongue member and said base member are discrete from each other while assembled together.

19. The electrical connector as claimed in claim 16, wherein either the tongue member and the signal contacts are configured to allow said signal contacts to be assembled to the tongue member in the vertical direction, or the extending post and the corresponding power contact are configured to allow said power contact to be assembled to the extending post in the vertical direction.

20. The electrical connector as claimed in claim 16, wherein said housing defines a mounting surface for being seated upon a printed circuit board, and said vertically expanded section is lower than said mounting surface.

* * * * *